US009279269B2

(12) United States Patent
Lovley, II et al.

(10) Patent No.: US 9,279,269 B2
(45) Date of Patent: Mar. 8, 2016

(54) CANOPY SHELTER BRACKETS

(71) Applicant: BRAVO SPORTS, Santa Fe Springs, CA (US)

(72) Inventors: Jack B. Lovley, II, Lake Forest, CA (US); Joseph C. Klingl, Los Angeles, CA (US); Mark Groenhuyzen, Long Beach, CA (US)

(73) Assignee: Bravo Sports, Santa Fe Springs, CA (US)

( * ) Notice: Subject to any disclaimer, the term of this patent is extended or adjusted under 35 U.S.C. 154(b) by 0 days.

(21) Appl. No.: 14/149,538

(22) Filed: Jan. 7, 2014

(65) Prior Publication Data

US 2014/0190541 A1 Jul. 10, 2014

Related U.S. Application Data

(60) Provisional application No. 61/750,235, filed on Jan. 8, 2013.

(51) Int. Cl.
*E04H 15/50* (2006.01)
*E04H 15/32* (2006.01)

(52) U.S. Cl.
CPC ..... *E04H 15/50* (2013.01); *E04H 15/32* (2013.01)

(58) Field of Classification Search
CPC ..... E04H 15/50
USPC ..... 135/131, 145, 120.3; 403/68, 70, 71, 403/79, 91, 258, 393; 248/512
See application file for complete search history.

(56) References Cited

U.S. PATENT DOCUMENTS

| | | | | | |
|---|---|---|---|---|---|
| 914,774 | A * | 3/1909 | Zimmerman | 403/71 |
| 1,334,048 | A * | 3/1920 | Powers | 248/291.1 |
| 4,445,590 | A * | 5/1984 | Ihrman | 182/222 |
| 4,949,929 | A * | 8/1990 | Kesselman et al. | 248/300 |
| 5,421,356 | A * | 6/1995 | Lynch | 135/145 |
| 5,551,669 | A * | 9/1996 | Reinklou | 256/65.03 |
| 5,695,296 | A * | 12/1997 | Miura | 403/2 |
| 7,240,685 | B2 * | 7/2007 | Seo | 135/120.3 |

(Continued)

FOREIGN PATENT DOCUMENTS

| | | |
|---|---|---|
| DE | 102010049941 | 5/2012 |
| KR | 100886118 | 2/2009 |

(Continued)

OTHER PUBLICATIONS

International Search Report and Written Opinion in related Application No. PCT/US2014/010376 mailed Jun. 5, 2014 in 6 pages.

*Primary Examiner* — David R Dunn
*Assistant Examiner* — Danielle Jackson
(74) *Attorney, Agent, or Firm* — Knobbe Martens Olson & Bear, LLP

(57) ABSTRACT

A canopy shelter bracket for increased structural integrity. The canopy shelter bracket can include an inner portion, an intermediate portion, a first outer portion, and a second outer portion integrally connected to form a generally "F" shape or an "S" shape. The inner portion, first outer portion, and/or the second outer portion can include holes for receiving a fastener therethrough to fasten the brackets to cross members. A single fastener can be used to fasten multiple cross members to the bracket. The first and/or second outer portions can additionally serve to space apart a first cross member from a second cross member.

21 Claims, 8 Drawing Sheets

(56) References Cited

U.S. PATENT DOCUMENTS

| | | | | |
|---|---|---|---|---|
| 7,422,026 | B2 * | 9/2008 | Kim | 135/131 |
| 7,836,907 | B2 * | 11/2010 | Carter | 135/131 |
| 8,220,477 | B2 * | 7/2012 | Park | 135/145 |
| 2003/0164185 | A1 * | 9/2003 | Price | 135/131 |
| 2004/0084074 | A1 * | 5/2004 | Chiu et al. | 135/131 |
| 2004/0255997 | A1 * | 12/2004 | Seo | 135/131 |
| 2004/0261828 | A1 * | 12/2004 | Jang | 135/131 |
| 2005/0028856 | A1 * | 2/2005 | Seo | 135/131 |
| 2006/0096631 | A1 * | 5/2006 | Mallookis et al. | 135/131 |
| 2007/0240748 | A1 * | 10/2007 | Bae | 135/145 |
| 2010/0102600 | A1 | 4/2010 | Lovley, II | |

FOREIGN PATENT DOCUMENTS

| | | |
|---|---|---|
| KR | 20110054253 | 5/2011 |
| SU | 1174551 | 8/1985 |
| WO | WO 94/23162 | 10/1994 |

* cited by examiner

CANOPY SHELTER BRACKETS

INCORPORATION BY REFERENCE TO PRIORITY APPLICATION

The present application claims priority to U.S. Provisional Application No. 61/750,235 filed Jan. 8, 2013, entitled CANOPY SHELTER BRACKETS, the entire contents of which are hereby expressly incorporated by reference herein and made a part of the present disclosure.

BACKGROUND OF THE INVENTION

1. Field of the Invention

The present invention relates to collapsible canopy frames and, in particular, canopy frames having improved connection brackets.

2. Description of the Related Art

Canopy shelters with collapsible frames are commonly used to provide portable shelter for outdoor activities such as camping, picnicking, parties, weddings, and more. Such collapsible canopy shelters typically comprise a canopy cover and a canopy frame configured to stand alone when in an expanded or deployed state and to collapse into a collapsed state for storage and transport.

While conventional canopy shelters are useful for a variety of purposes, such as providing portable shade and/or shelter from the elements and providing an aesthetically pleasing backdrop for special events, conventional canopy frames leave room for improvement with respect to structural integrity. Some conventional canopy frame designs are vulnerable to misalignment, excessive friction, and twisting, which make the canopy difficult to expand and collapse.

Canopy frames are generally constructed of cross members which pivot relative to one another during expansion and collapse of the frame. In certain configurations, particularly in a canopy frame including a center lift tube, perpendicular cross members come together at a T point. Some canopy frames utilize a bracket at the T point to position one cross member generally perpendicular to at least one additional cross member.

SUMMARY OF THE INVENTION

The systems, methods and devices described herein have innovative aspects, no single one of which is indispensable or solely responsible for their desirable attributes. Without limiting the scope of the claims, some of the advantageous features will now be summarized.

One aspect of the present invention is the realization that the bracket utilized to maintain the generally perpendicular orientation between cross members adds unwanted flexibility to the canopy frame, creating misalignment, excessive friction, and twisting of the canopy frame. This flexibility reduces the structural integrity of the frame as well as making the frame more difficult to expand and collapse. Thus, there exists need for an improved bracket design.

One non-limiting embodiment of the present invention includes an F-bracket comprising an inner portion, an intermediate portion, a first outer portion, and a second outer portion. The F-bracket pivotally engages both sides of an outer cross member, increasing the structural integrity and stiffness of the canopy frame and helping to maintain proper alignment of the cross members and making expansion and collapse of the canopy frame much smoother and easier.

Another non-limiting embodiment of the present invention includes an S-bracket comprising an inner portion, an intermediate portion, a first outer portion, and a second outer portion. The S-bracket pivotally engages both sides of an outer cross member, increasing the structural integrity and stiffness of the canopy frame and helping to maintain proper alignment of the cross members and making expansion and collapse of the canopy frame much smoother and easier.

In one embodiment, a bracket includes an intermediate portion, an inner portion, a first outer portion, and a second outer portion, wherein the inner portion, first outer portion, and the second outer portion are each connected to the intermediate portion such that the inner portion is substantially perpendicular to the first outer portion and the second outer portion and such that the first outer portion and the second outer portion are substantially parallel and spaced apart. In some embodiments, at least one of the inner portion, the first outer portion and the second outer portion include one or more holes allowing a cross-member to be pivotally coupled to the at least one of the inner portion, the first outer portion, and the second outer portion. In some embodiments, the first outer portion and the second outer portion are sized to receive a cross-member, the first outer portion being proximal a first side of the cross member and the second outer portion being proximal an opposite side of the cross member. In some embodiments, the first outer portion and the second outer portion are connected to a first side of the intermediate portion and the inner portion is connected to a second side of the intermediate portion. In some embodiments, at least one of the inner portion, the first outer portion, and the second inner portion include a receiver portion. In some embodiments, the receiver portion includes a cavity with surfaces sized and shaped to receive at least one of a retaining member and fastener.

In one embodiment, a bracket includes an intermediate portion, an inner portion, a first outer portion, and a second outer portion, wherein the first outer portion and the second outer portion are each connected to the intermediate portion such that the first outer portion and the second outer portion are substantially parallel and spaced apart and the inner portion is attached to one of the first outer portion and the second outer portion such that the inner portion is substantially perpendicular to the first outer portion and the second outer portion. In some embodiments, at least one of the inner portion, the first outer portion and the second outer portion include one or more holes allowing a cross-member to be pivotally coupled to the at least one of the inner portion, the first outer portion, and the second outer portion. In some embodiments, the first outer portion and the second outer portion are sized to receive a cross-member, the first outer portion being proximal a first side of the cross member and the second outer portion being proximal an opposite side of the cross member. In some embodiments, at least one of the inner portion, the first outer portion, and the second inner portion include a receiver portion. In some embodiments, the receiver portion includes a cavity with surfaces sized and shaped to receive at least one of a retaining member and fastener.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 1A:
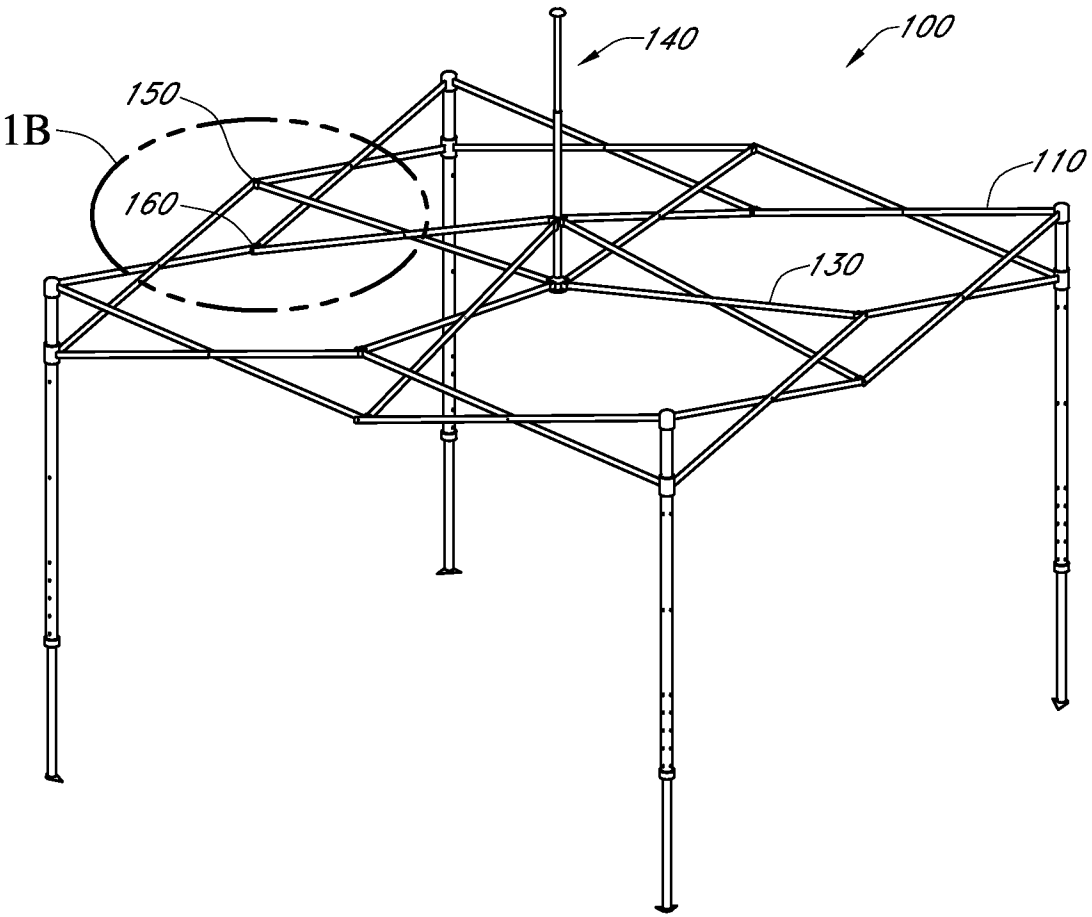
FIG. 1A illustrates a perspective view of one type of collapsible canopy frame.

FIG. 1A illustrates a perspective view of one type of collapsible canopy frame 100. In one embodiment, the collapsible canopy frame 100 comprises a plurality cross members 110, 130 arranged and pivotally coupled such that the canopy frame 100 may be expanded and collapsed between an expanded state and a collapsed state. One embodiment of a canopy frame is described in U.S. Patent Publication No. 2009/0071521, to Sy-Facunda, the entirety of which is hereby incorporated by reference herein. In one embodiment, the canopy frame comprises an interior support or lift tube (e.g., a center support or center lift tube 140) configured to support an interior portion (e.g., the center) of the canopy cover (not illustrated) in an expanded state. In a square canopy, the interior support may be a center support. In a rectangular canopy, the interior support can be off-center. In particular, multiple interior supports can be provided in a rectangular canopy, with the interior supports often centered in the small dimension direction and evenly spaced along the large dimension direction. Multiple interior supports can be provide in any shape canopy, if desired. The term "center support" or "center lift tube" is used herein for convenience and can include any interior support unless indicated otherwise.

The canopy frame 100 comprises a plurality of outer cross members 110 throughout the perimeter of the canopy frame 100. The canopy frame 100 further comprises a plurality of inner cross members 130. In one embodiment, the inner cross members 130 are pivotally coupled to at least one outer cross member 110 and the center lift tube 140. As described above, in some embodiments, the canopy frame may comprise more than one center lift tube (not illustrated). In some embodiments, the inner cross members may pivotally couple to multiple center lift tubes (not illustrated). In some embodiments, a plurality of inner cross members 130 may couple the outside cross members 110 to the center lift tube 140.

Figure 1B:
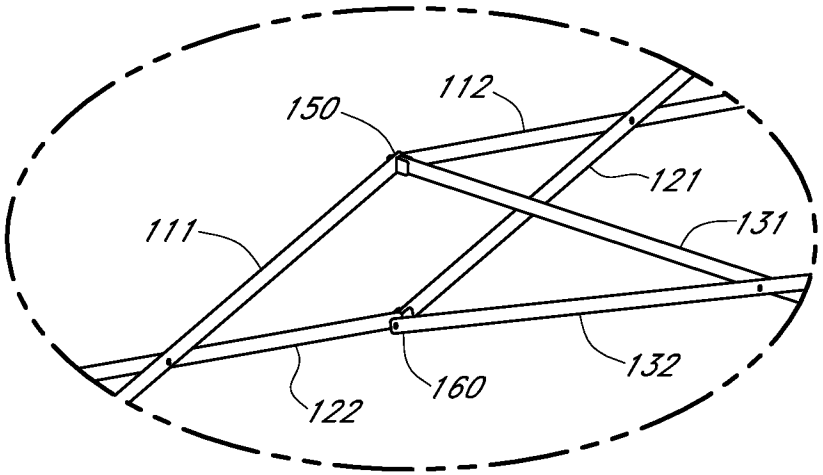
FIG. 1B illustrates a perspective view of a portion of one type of collapsible canopy frame.
Figure 2:
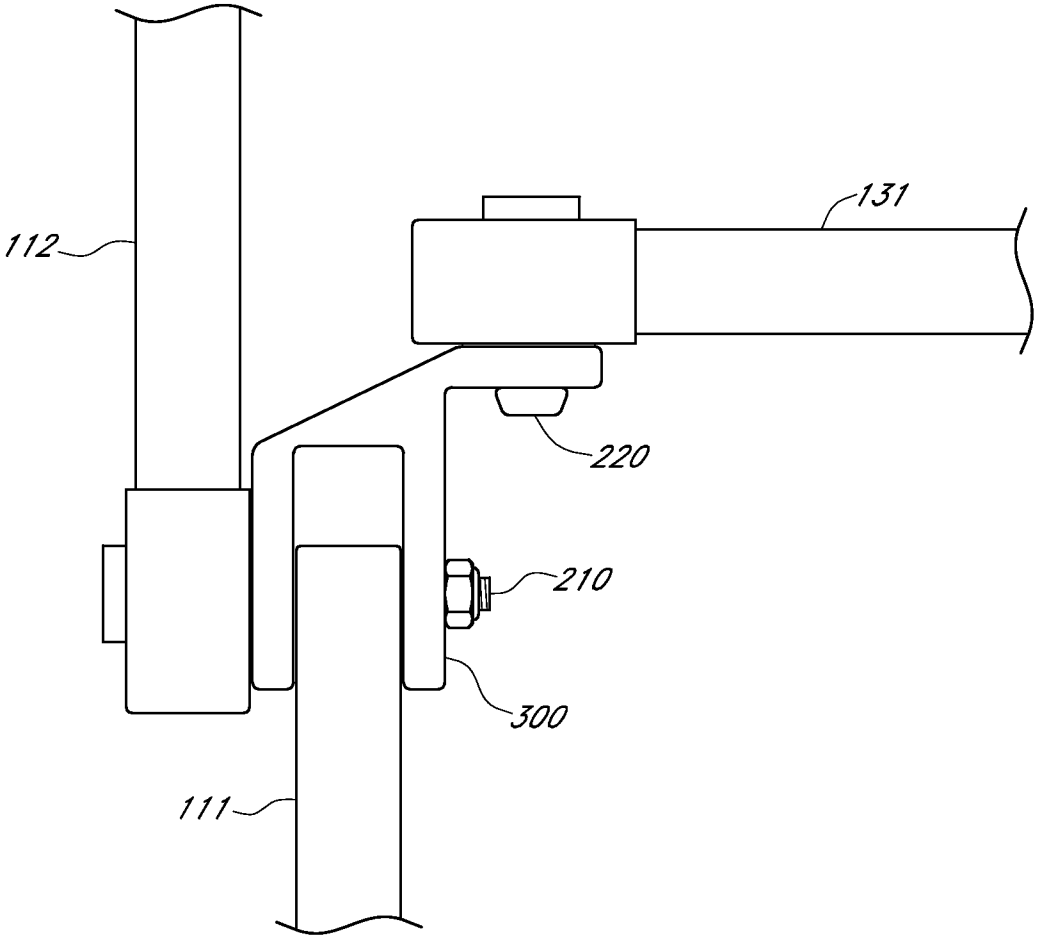
FIG. 2 illustrates a top plan view of an upper T-point and an F-bracket.

FIG. 1B illustrates a perspective view of a portion of one type of collapsible canopy frame 100. In one embodiment, a first upper outer cross member 111 is pivotally coupled to a second upper outer cross member 112 at an upper T-point 150. An upper inner cross member 131 is pivotally coupled to the upper T-point 150 by way of a bracket 300, 400. The upper inner cross member 131 is generally or substantially perpendicular to the first upper outer cross member 111 and second upper outer cross member 112 from a plan view perspective as illustrated in FIG. 2. A first lower outer cross member 121 is pivotally coupled to a second lower outer cross member 122 at a lower T-point 160. A lower inner cross member 132 is pivotally coupled to the lower T-point 160 by way of a bracket 300, 400. The lower inner cross member 131 is generally or substantially perpendicular to the first lower outer cross member 121 and second lower outer cross member 122 from a plan view perspective as illustrated in FIG. 5. In some embodiments, a canopy frame 100 comprises a plurality of upper T-points 150 and lower T-points 160. The term "T-point" as used herein refers to the meeting of one support element or member with one or more other, non-parallel support element(s) or member(s). At least two of the support elements or members can be generally, substantially or exactly perpendicular to one another.

FIG. 2 illustrates a perspective view of an upper T-point 150 and an F-bracket 300. In one embodiment, each cross member 111, 112, 131 has a hole formed therethrough near the end of each cross member 111, 112, 131. The hole allows an outer fastener 210 to be installed through both the first upper outer cross member 111 and the second upper outer cross member 112, pivotally coupling them at the upper T-point 150. In one embodiment, the upper T-point 150 further comprises an F-bracket 300. The F-bracket 300 is configured to pivotally couple the inner upper cross member 131 to both the first upper outer cross member 111 and second upper outer cross member 112. The F-bracket 300 is also configured to constrain the inner upper cross member 131 to be generally or substantially perpendicular to the first upper outer cross member 111 and second upper outer cross member 112 from a plan view perspective.

Figure 3B:
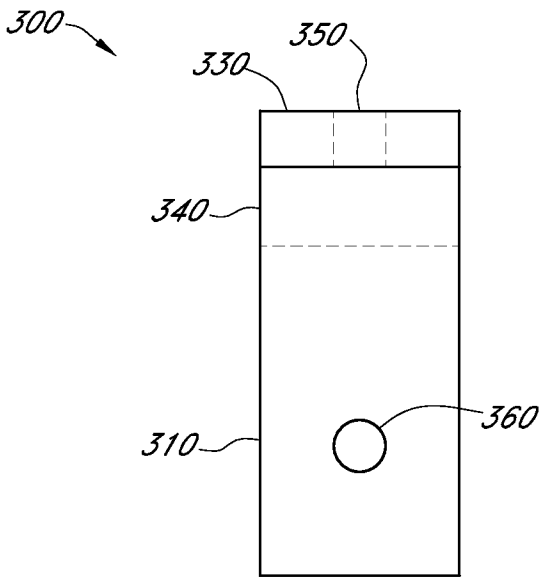
FIG. 3B illustrates a side view of an F-bracket.
Figure 3A:
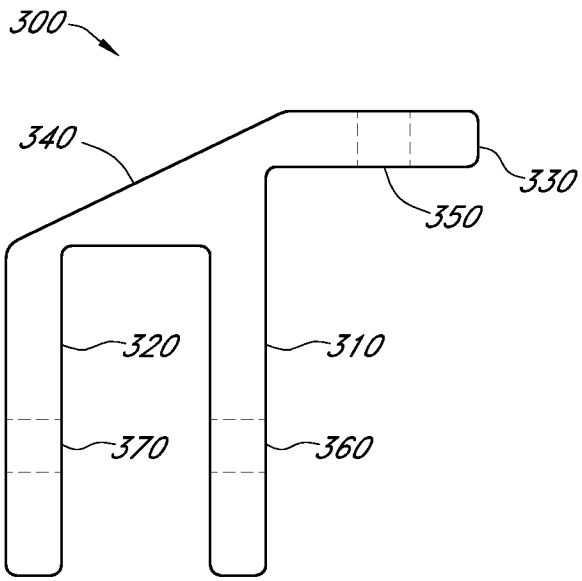
FIG. 3A illustrates a top plan view of an F-bracket.

FIG. 3A illustrates a top plan view of an F-bracket 300. FIG. 3B illustrates a side view of an F-bracket 300. The F-bracket 300 comprises an inner portion 330, an intermediate portion 340, a first outer portion 310, and a second outer portion 320. The inner portion 330, first outer portion 310, and second outer portion 320 are integrally connected to the intermediate portion 340 to form a generally "F" shape. The term F-bracket 300 is used as a convenience herein and is not intended to limit the shape of the bracket 300 unless otherwise indicated. In some configurations, the overall shape of the bracket 300 is an "F" shape; however, the bracket 300 can also have additional portions such that the overall shape is other than F-shaped. In one embodiment the inner portion 330, first outer portion 310, and second outer portion 320 comprise substantially rectangular projections from the intermediate portion 340 configured to pivotally couple to a cross member 110, 130, 111, 112, 121, 122. In some embodiments, the inner portion 330, first outer portion 310, and/or second outer portion 320 may comprise curved shapes and/or rounded corners. In some configurations, at least a portion of the intermediate portion 340 defines a thickness that is greater than the thickness of the inner portion 330, the first outer portion 310 and/or the second outer portion 320. In some configurations, the intermediate portion 340 is generally or substantially triangular in shape from a plan view perspective.

In one embodiment the inner portion 330, first outer portion 310, and second outer portion 320 each has a hole 350, 360, 370 formed therethrough to accept one or more fasteners, such as fasteners 210, 220. The inner portion 330 is configured to receive the inner fastener 220 and pivotally couple the F-bracket 300 to the inner upper cross member 131. The first outer portion 310 and the second outer portion 320 are configured to receive the outer fastener 210 and pivotally couple the F-bracket 300 to the first upper outer cross member 111. In some embodiments, a single fastener 210 can be used to couple more than one fastener. For example, as shown in FIG. 2, fastener 210 can couple cross members 111 and 112 to the F-bracket 300. In one embodiment, the inner portion 330 is generally or substantially perpendicular to the first outer portion 310 and the second outer portion 320. In one embodiment, the first outer portion 310 is generally or substantially parallel to the second outer portion 320. In one embodiment, the F-bracket 300 is configured to maintain a generally or substantially perpendicular relationship from a plan view perspective between the inner upper cross member 131 and both the first upper outer cross member 111 and second upper outer cross member 112.

In one embodiment, the first outer portion 310 is configured to pivotally engage one side of the first upper outer cross member 111 and the second outer portion 320 is configured to pivotally engage the opposite side of the first upper outer cross member 111. By pivotally engaging both sides of the first upper outer cross member 111, the structural integrity and stiffness of the F-bracket 300 is increased, helping to maintain proper alignment of the cross members 111, 112, 131 and making expansion and collapse of the canopy frame 100 much smoother and easier. In one embodiment, a portion of the F-bracket 300, preferably the second outer portion 320 is located between the first upper outer cross member 111 and the second upper outer cross member 112. In one embodiment, the first outer portion 310 and the second outer portion 320 are configured to receive the outer fastener 210 and pivotally couple the F-bracket 300 to the first upper outer cross member 111 and the second upper outer cross member 112. Thus, in some configurations, the second outer portion 320 of the F-bracket 300 can supplement or replace a spacer (e.g., a washer) between the first upper outer cross member 111 and the second upper outer cross member 112.

Figure 4:
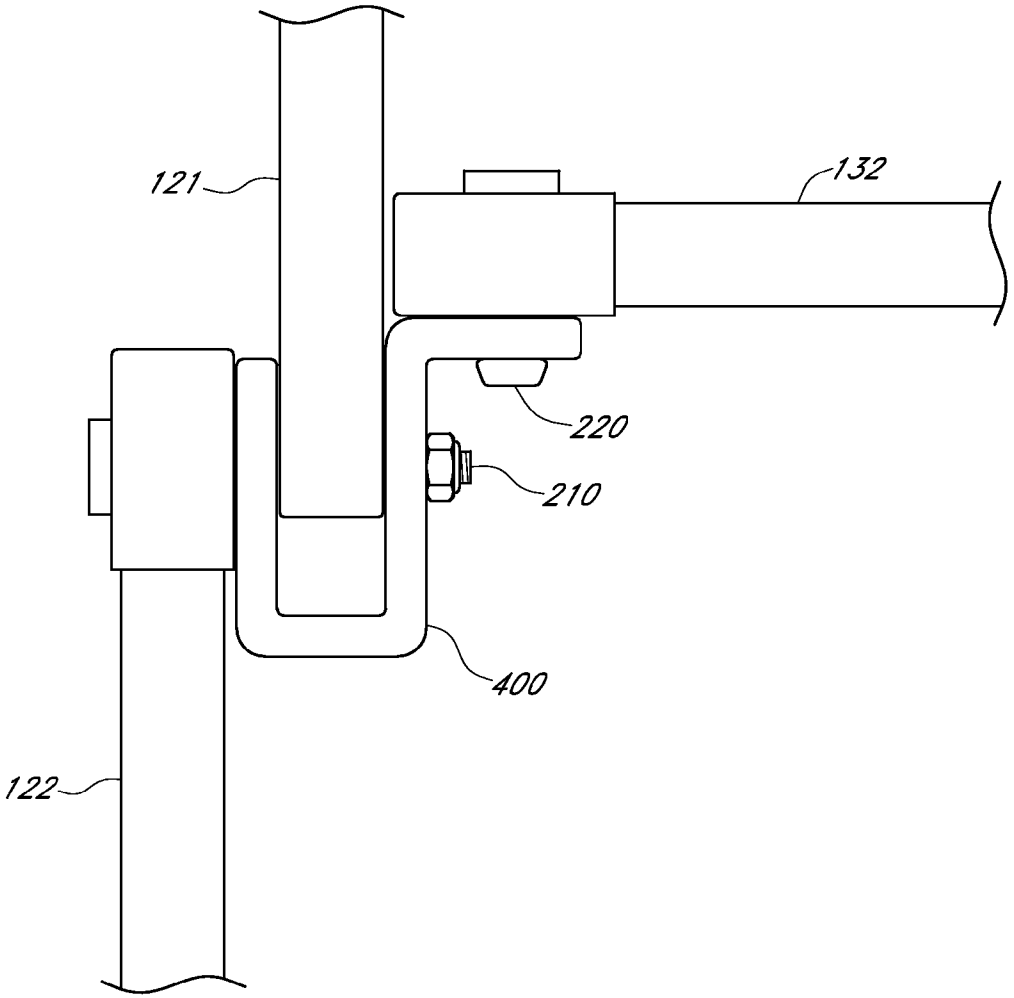
FIG. 4 illustrates a top plan view of a lower T-point and an S-bracket.

FIG. 4 illustrates a perspective view of a lower T-point 160 and an S-bracket 400. In one embodiment, each cross member 121, 122, 132 has a hole formed therethrough near the end of each cross member 121, 122, 132. The hole allows an outer fastener 210 to be installed through both the first lower outer cross member 121 and the second lower outer cross member 122, pivotally coupling them at the lower T-point 160. In one embodiment, the lower T-point 160 further comprises an S-bracket 400. The S-bracket 400 is configured to pivotally couple the inner lower cross member 132 to the both the first lower outer cross member 121 and second lower outer cross member 122. The S-bracket 400 is also configured to constrain the inner lower cross member 132 to be generally or substantially perpendicular to the first lower outer cross member 121 and second lower outer cross member 122 from a plan view perspective.

Figure 5B:
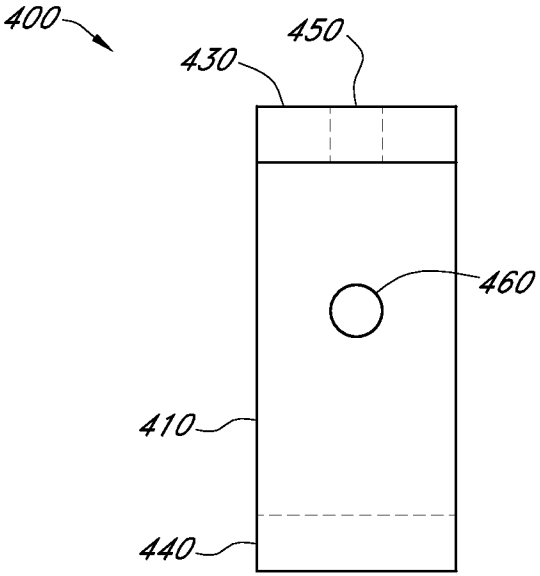
FIG. 5B illustrates a side view of an S-bracket.
Figure 5A:
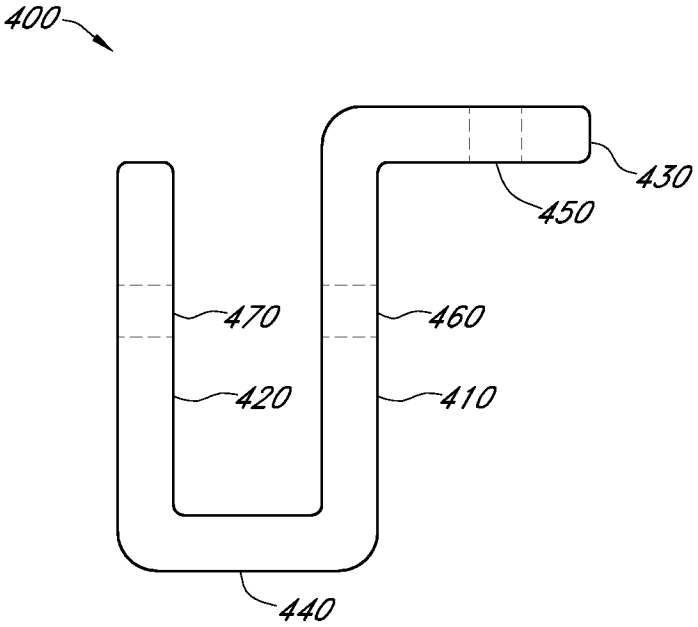
FIG. 5A illustrates a top plan view of an S-bracket.

FIG. 5A illustrates a top plan view of an S-bracket 400. FIG. 5B illustrates a side view of an S-bracket 400. The S-bracket 400 comprises an inner portion 430, an intermediate portion 440, a first outer portion 410, and a second outer portion 420. The first outer portion 410 and second outer portion 420 are integrally connected to the intermediate portion 440 to form a partial "S" shape. The term "S-bracket" is used herein for convenience and is not intended to limit the shape of the bracket 400 unless otherwise indicated. In addition, the bracket 400 can have other portions such that the overall shape of the bracket 400 is other than that shown in the figures. The inner portion 430 is integrally connected to the first outer portion 410. In another embodiment, the inner portion is integrally connected to the second outer portion (not illustrated). In one embodiment the first outer portion 410 and second outer portion 420 comprise substantially rectangular projections from the intermediate portion 440 configured to pivotally couple to the first lower outer cross member 410. In one embodiment, the inner portion 430 comprises a substantially rectangular projection from the first outer portion 410 configured to pivotally couple to the lower inner cross member 132. In some embodiments, the inner portion 430, first outer portion 410, and/or second outer portion 420 may comprise curved shapes and/or rounded corners.

In one embodiment the inner portion 430, first outer portion 410, and second outer portion 420 each has a hole 450, 460, 470 formed therethrough to accept a fastener 210, 220. The inner portion 430 is configured to receive the inner fastener 220 and pivotally couple the S-bracket 400 to the inner lower cross member 132. The first outer portion 410 and the second outer portion 420 are configured to receive the outer fastener 220 and pivotally couple the S-bracket 400 to the first lower outer cross member 121. In one embodiment, the inner portion 430 is generally or substantially perpendicular to the first outer portion 410 and the second outer portion 420. In one embodiment, the first outer portion 410 is generally or substantially parallel to the second outer portion 420. In one embodiment, the S-bracket 400 is configured to maintain a generally or substantially perpendicular relationship from a plan view perspective between the inner lower cross member 132 and both the first lower outer cross member 121 and second lower outer cross member 122. In one embodiment, the first outer portion 410 is configured to pivotally engage one side of the first lower outer cross member 121 and the second outer portion 420 is configured to pivotally engage the opposite side of the first lower outer cross member 121. By pivotally engaging both sides of the first lower outer cross member 121, the structural integrity and stiffness of the S-bracket 400 is increased, helping to maintain proper alignment of the cross members 121, 122, 132 and making expansion and collapse of the canopy frame 100 much smoother and easier. In one embodiment, a portion of the S-bracket 400, preferably the second outer portion 420 is located between the first lower outer cross member 121 and the second lower outer cross member 122 and can supplement or replace a spacer (e.g., washer) between the two cross members. In one embodiment, the first outer portion 410 and the second outer portion 420 are configured to receive the outer fastener 210 and pivotally couple the S-bracket 400 to the first lower outer cross member 121 and the second lower outer cross member 122.

In one embodiment, the canopy frame comprises both F-brackets 300 and S-brackets 400. In one embodiment, the F-bracket 300 is configured to offset the inner upper cross member 131 away from the center of the first upper outer cross member 111. The inner portion 330 of the F-bracket 300 is located on the opposite side of the intermediate portion 340 as the first outer hole 360 in the first outer portion 310 and second outer hole 370 in the second outer portion 320 of the F-bracket 300. In one embodiment, the S-bracket 400 is configured to offset the inner lower cross member 131 towards the center of the first lower outer cross member 121. The inner portion 430 of the S-bracket is located on the same side of the intermediate portion 440 as the first outer hole 460 in the first outer portion 410 and second outer hole 470 in the second outer portions 420 of the S-bracket 400.

In one embodiment of a canopy frame 100, the majority of the first upper outer cross member 111 is located on one side of the upper T-point 150 and the majority of the first lower outer cross member 121 is located on the opposite side of the lower T-point 160 (as illustrated in FIGS. 2-3 and FIGS. 5-6). By utilizing an F-bracket 300 at an upper T-point 150 and an S-bracket 400 at a lower T-point 160, or vice versa, the inner upper cross member 131 and inner lower cross member 132 are offset in the same direction from the outer fasteners 210 from a plan view perspective (as illustrated in FIGS. 2 and 4). This offset allows the inner upper cross member 131 and inner lower cross member 132 to pivotally couple to one another (as illustrated in FIG. 1B) and the canopy frame 100 to expand or collapse in a smooth manner.

The F-brackets 300 and S-brackets 400 are capable of additional configurations and orientations to those disclosed above. For example, the F-bracket may be utilized at the lower T-point 160 and may pivotally couple to the first lower outer cross member 121. The F-bracket may pivotally engage both sides of the first lower cross member 121. In another embodiment, the F-bracket may pivotally engage both sides of the second upper outer cross member 112. In another embodiment, the F-bracket may pivotally engage both sides of the second lower outer cross member 122. The S-bracket may be utilized at the upper T-point 150 and may pivotally couple to the first upper cross member 111. The S-bracket may pivotally engage both sides of the first upper cross member 111. In another embodiment, the S-bracket may pivotally engage both sides of the second lower outer cross member 122. In another embodiment, the S-bracket may pivotally engage both sides of the second upper outer cross member 112.

In one embodiment, a fastener 210, 220 may comprise a bolt. The bolt is held in place by a retaining member. In one embodiment the retaining member comprises a nut having an annular body with a threaded internal surface configured to couple with the threaded surface of the fastener and an outer surface comprising plurality of flat surfaces. In other embodiments the retaining member comprises a circlip or a locking ring. In some embodiments, the fastener comprises a rivet assembly, a snap pin, or an expanding locking collar (not illustrated).

In one embodiment, the brackets 300, 400 are monolithic in construction. In other embodiments the brackets may be constructed of multiple pieces joined together (not illustrated). In one embodiment, the brackets may be constructed of an assortment of materials, for example, rubber, plastic, thermoplastic, thermoset, acrylonitrile butadiene styrene, polycarbonate alloy, acetal, acrylic, nylon, polybutylene terephthalate, polyester liquid crystal polymer, polypropylene, polycarbonate, polyimide, polythelene, steel, stainless steel, aluminum, titanium, or another metal material. In one embodiment, the brackets may be formed in an injection molded process. In one embodiment, the material may be reinforced with glass or carbon fibers. In one embodiment the brackets may be formed through an extrusion process. In one embodiment the brackets may be formed by bending a flat piece of material. In one embodiment the brackets may be coated to prevent corrosion.

Figure 6B:
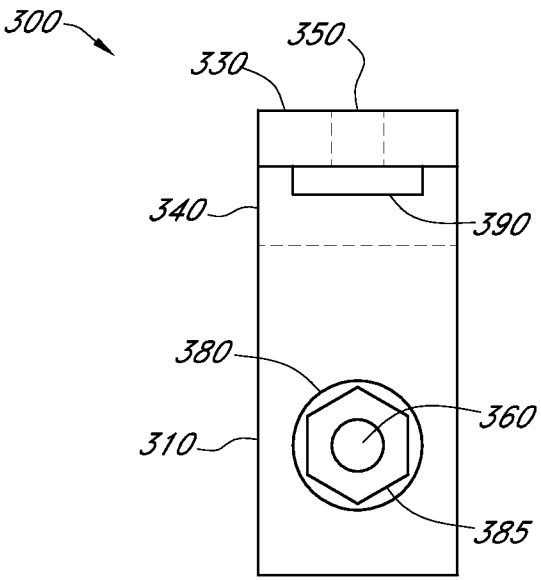
FIG. 6B illustrates a side view of another embodiment of an F-bracket.
Figure 6A:
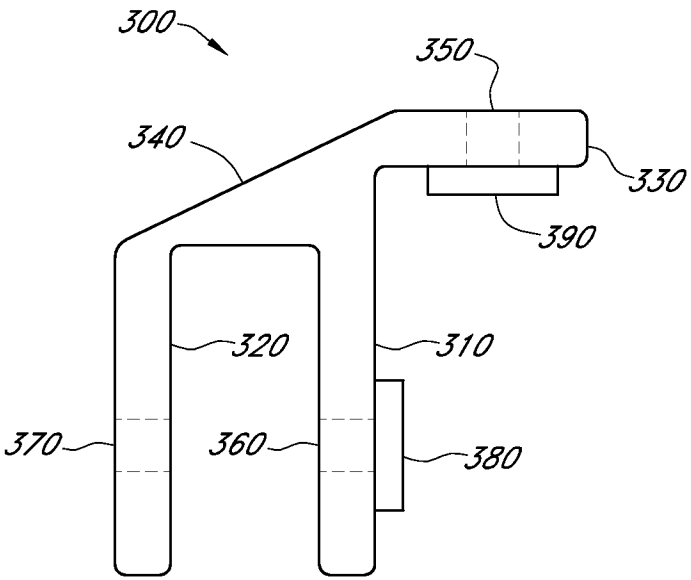
FIG. 6A illustrates a top plan view of another embodiment of an F-bracket.
Figure 7B:
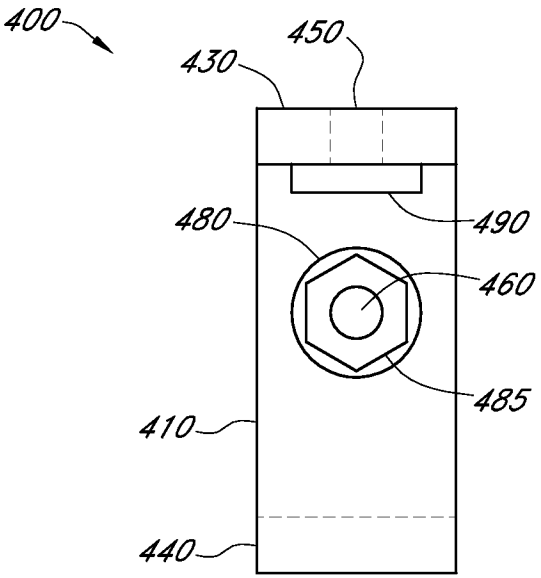
FIG. 7B illustrates a side view of another embodiment of an S-bracket.
Figure 7A:
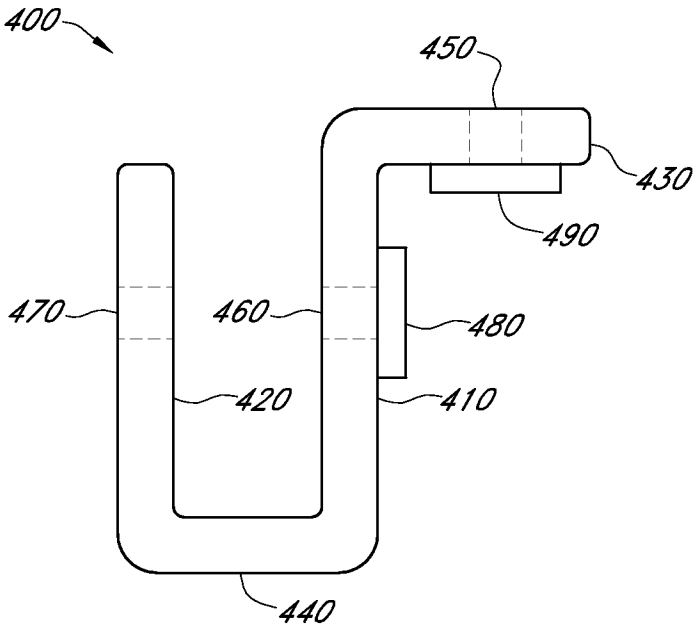
FIG. 7A illustrates a top plan view of another embodiment of an S-bracket.

As shown in FIGS. 6A, 6B, 7A and 8B, in some embodiments, the brackets 300, 400 may also include a receiver portion located on the first outer portion, such as receiver portions 380, 480 and/or the inner portion, such as receiver portions 390, 490, of the bracket. The receiver portion comprises a protrusion centered around the inner and/or outer holes, such as holes 350, 360, 450, 460, and has a cavity, such as cavities 385, 485, formed therein to receive a retaining member. In one embodiment, the internal surface of the cavity may be shaped to compliment the outer surface of the retaining member, for example, it may comprise a plurality of flat surfaces to lock the retaining member in place, thus allowing more efficient installation of the fastener and retaining member and quicker assembly of the canopy frame. As shown in FIGS. 6B and 7B, the cavity has a hexagonal shape to compliment a hexagonal nut.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A bracket for a canopy frame comprising:

an intermediate portion;

an inner portion integrally connected to the intermediate portion, wherein the inner portion comprises a projection configured to pivotally couple to a cross member;

a first outer portion integrally connected to the intermediate portion, wherein the first outer portion comprises a projection configured to pivotally couple to at least one cross member; and a second outer portion integrally connected to the intermediate portion, wherein the second outer portion comprises a projection configured to pivotally couple to at least two cross members such that axes of rotation of at least two of the cross members pivotally attached to the second outer portion are positioned on a same side of a longitudinal axis of the cross member pivotally coupled to the inner portion, wherein at least two of the cross members pivotally coupled to the projection of the second outer portion are configured to rotate towards different directions;

wherein the inner portion, the first outer portion, and the second outer portion each have a hole formed therethrough configured to receive a fastener and pivotally couple each portion to at least one cross member;

wherein the inner portion is substantially perpendicular to the first outer portion and the second outer portion; and wherein the first outer portion and the second outer portion are substantially parallel.

2. The bracket of claim 1, wherein the first outer portion is configured to pivotally engage one side of a cross member and the second outer portion is configured to pivotally engage an opposite side of the cross member.

3. The bracket of claim 1, wherein the bracket forms a generally "F" shape.

4. The bracket of claim 1, wherein the projection of the second outer portion is configured to pivotally couple to at least two cross members positioned along opposite sides of the projection.

5. The system of claim 1, wherein at least two of the cross members pivotally coupled to the second outer portion share the same axis of rotation.

6. The bracket of claim 5, wherein the holes of the first and second outer portions are positioned to receive a single, longitudinally extending fastener to pivotally couple the second outer portion to the at least two cross members having the same axis of rotation.

7. The bracket of claim 1, wherein at least two of the cross members pivotally coupled to the projection of the second outer portion are configured to rotate towards substantially opposite directions.

8. A bracket for a canopy frame comprising:

an intermediate portion;

a first outer portion integrally connected to the intermediate portion at a first end of the first outer portion, wherein the first outer portion comprises a projection configured to pivotally couple to at least one cross member; and a second outer portion integrally connected to the intermediate portion, wherein the second outer portion comprises a projection configured to pivotally couple to at least two cross members;

an inner portion integrally connected to a second end of the first outer portion, wherein the inner portion comprises a projection configured to pivotally couple to a cross member;

wherein axes of rotation of at least two of the cross members pivotally attached to the second outer portion are positioned on a same side of a longitudinal axis of the cross member pivotally coupled to the inner portion;

wherein at least two of the cross members pivotally coupled to the projection of the second outer portion are configured to rotate towards different directions;

wherein the inner portion, the first outer portion, and the second outer portion each have a hole formed therethrough configured to receive a fastener and pivotally couple each portion to at least one cross member;

wherein the inner portion is substantially perpendicular to the first outer portion and the second outer portion; and wherein the first outer portion and the second outer portion are substantially parallel.

9. The bracket of claim 8, wherein the first outer portion is configured to pivotally engage one side of a cross member and the second outer portion is configured to pivotally engage an opposite side of the cross member.

10. The bracket of claim 8, wherein the bracket forms a partial "S" shape.

11. The bracket of claim 8, wherein the projection of the second outer portion is configured to pivotally couple to at least two cross members positioned along opposite sides of the projection.

12. The system of claim 8, wherein at least two of the cross members pivotally coupled to the second outer portion share the same axis of rotation.

13. The bracket of claim 12, wherein the holes of the first and second outer portions are positioned to receive a single, longitudinally extending fastener to pivotally couple the second outer portion to the at least two cross members having the same axis of rotation.

14. The bracket of claim 8, wherein at least two of the cross members pivotally coupled to the projection of the second outer portion are configured to rotate towards substantially opposite directions.

15. A canopy frame system comprising:

a first bracket, the first bracket comprising:

an intermediate portion;

an inner portion integrally connected to the intermediate portion, wherein the inner portion comprises a projection configured to pivotally couple to a cross member;

a first outer portion integrally connected to the intermediate portion, wherein the first outer portion comprises a projection configured to pivotally couple to at least one cross member; and a second outer portion integrally connected to the intermediate portion, wherein the second outer portion comprises a projection configured to pivotally couple to a plurality of cross members, the second outer portion positioned in a space formed between longitudinally extending sides of at least two of the plurality of cross members, wherein at least two of the cross members pivotally coupled to the projection of the second outer portion are configured to pivot independently of each other;

wherein the inner portion, the first outer portion, and the second outer portion each have a hole formed therethrough configured to receive a fastener and pivotally couple each portion to at least one cross member;

wherein the inner portion is substantially perpendicular to the first outer portion and the second outer portion;

wherein the first outer portion and the second outer portion are substantially parallel;

a second bracket, the second bracket comprising:

an intermediate portion;

a first outer portion integrally connected to the intermediate portion, wherein the first outer portion comprises a projection configured to pivotally couple to at least one cross member; and a second outer portion integrally connected to the intermediate portion, wherein the second outer portion comprises a projection configured to pivotally couple to a plurality of cross members, the second outer portion positioned in a space formed between longitudinally extending sides of at least two of the plurality of cross members, wherein at least two of the cross members pivotally coupled to the projection of the second outer portion are configured to pivot independently of each other;

an inner portion integrally connected to the first outer portion, wherein the inner portion comprises a projection configured to pivotally couple to a cross member;

wherein the inner portion, the first outer portion, and the second outer portion each have a hole formed therethrough configured to receive a fastener and pivotally couple each portion to at least one cross member;

wherein the inner portion is substantially perpendicular to the first outer portion and the second outer portion;

wherein the first outer portion and the second outer portion are substantially parallel; and wherein a cross member pivotally coupled to the first bracket and a cross member pivotally coupled to the second bracket are pivotally coupled to each other.

16. The system of claim 15, wherein the first outer portion of the first bracket is configured to pivotally engage one side of a cross member and the second outer portion is configured to pivotally engage an opposite side of the cross member.

17. The system of claim 15, wherein the first outer portion of the second bracket is configured to pivotally engage one side of a cross member and the second outer portion is configured to pivotally engage an opposite side of the cross member.

18. The system of claim 15, wherein the first bracket forms a generally "F" shape.

19. The system of claim 15, wherein the second bracket forms a partial "S" shape.

20. The system of claim 15, wherein:

at least two of the cross members pivotally coupled to the second outer portion of the first bracket share the same axis of rotation; and at least two of the cross members pivotally coupled to the second outer portion of the second bracket share the same axis of rotation.

21. The system of claim 15, wherein the second outer portions of the first and second brackets are configured to supplement or replace a spacer.

* * * * *